United States Patent [19]

Miller

[11] Patent Number: 4,622,785

[45] Date of Patent: Nov. 18, 1986

[54] APPARATUS FOR ATTACHMENT TO THE SIDE OF A BUILDING FOR HOLDING A RAIN GUTTER IN PLACE

[76] Inventor: Melvin L. Miller, 395 Highland Dr., Payette, Id. 83661

[21] Appl. No.: 812,077

[22] Filed: Dec. 23, 1985

[51] Int. Cl.[4] ..... E04D 13/00

[52] U.S. Cl. ..... 52/11; 248/48.2

[58] Field of Search ..... 52/11; 248/48.1, 48.2, 248/222.3

[56] References Cited

U.S. PATENT DOCUMENTS

| | | | |
|---|---|---|---|
| 1,105,390 | 7/1914 | Whedon . | |
| 1,940,369 | 12/1933 | Peal | 108/29 |
| 2,712,915 | 7/1955 | Cohen et al. | 248/48.2 |
| 2,843,063 | 2/1954 | Thomson | 108/28 |
| 2,978,214 | 7/1958 | Sheets | 248/48.2 |
| 3,150,851 | 9/1964 | Ritchie et al. | 248/48.2 |
| 3,189,304 | 12/1961 | Vranyosovics | 248/48.2 |
| 3,295,803 | 1/1967 | Blayden | 52/11 X |
| 3,344,562 | 10/1967 | Miles et al. | 248/48.2 X |
| 3,550,381 | 5/1969 | South | 61/15 |
| 3,612,453 | 10/1971 | Zimmer | 52/11 X |
| 3,874,131 | 4/1975 | Webster | 52/11 |
| 4,178,656 | 12/1979 | MacFarlane | 248/222.3 X |
| 4,195,452 | 4/1980 | Smith et al. | 52/11 |
| 4,311,292 | 1/1982 | Deason | 248/48.2 |
| 4,432,518 | 2/1984 | Navarre | 248/48.2 |

*Primary Examiner*—Carl D. Friedman

*Attorney, Agent, or Firm*—William D. Hall

[57] ABSTRACT

Apparatus for holding a rain gutter having a strip running the length of the gutter. The strip may be nailed to the side of a building. The strip has an internal cavity running the length of the strip. The strip has an entrance opening to the cavity. The lower part of the strip includes a hook which cooperates with a hook at the upper end of one leg of a U-shaped gutter to suspend that leg of the gutter from the strip. The other leg of the U-shaped gutter is held in place by a series of cantilever beams. Each cantilever has a bar on one end that locks into the cavity in the strip. The cantilever projects through the entrance opening of the cavity and extends above the U-shaped gutter to support one of the legs of the U-shaped gutter. The strip with its cavity and opening acts as a socket into which the cantilevers with their associated bars may be inserted as required.

6 Claims, 4 Drawing Figures

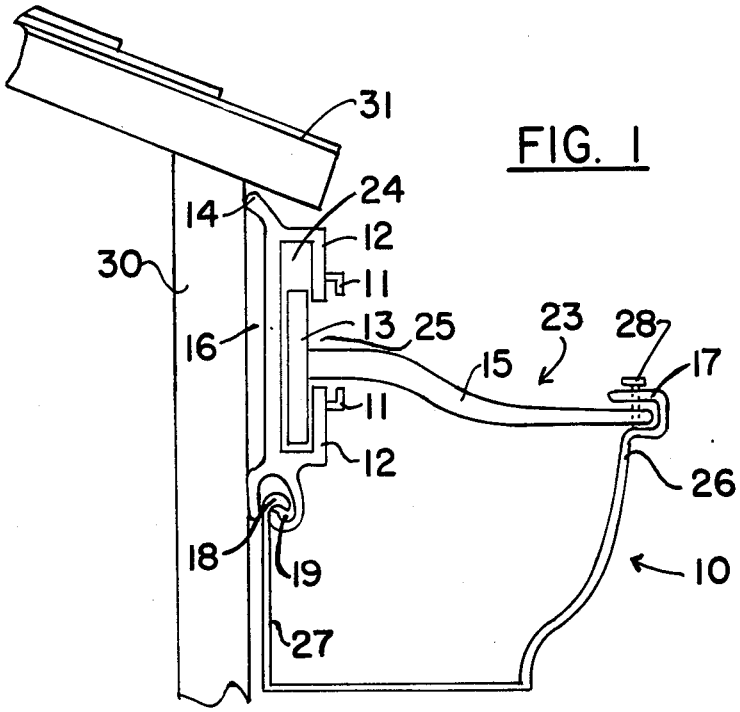
FIG. 1
FIG. 2
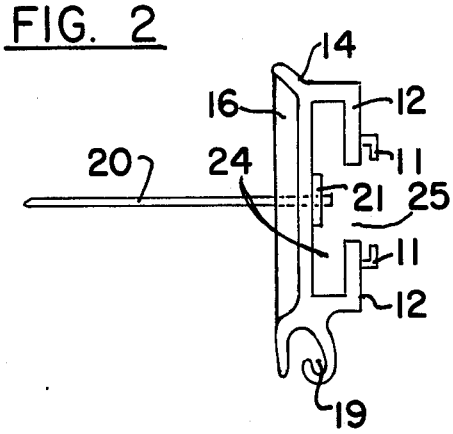
FIG. 3
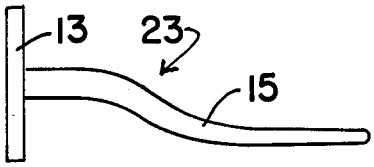
FIG. 4
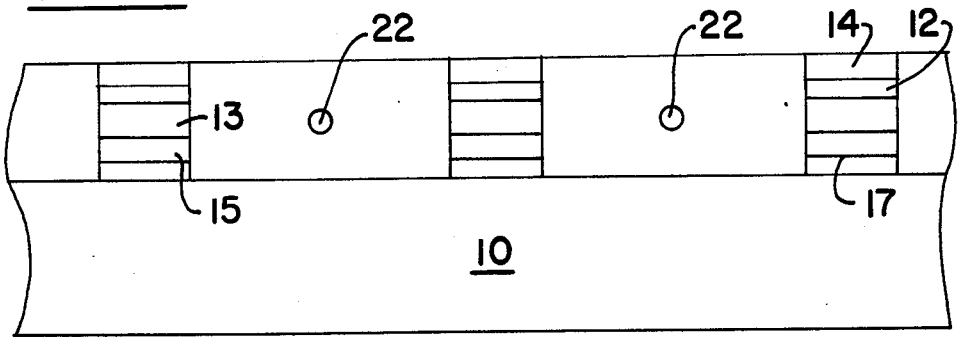

APPARATUS FOR ATTACHMENT TO THE SIDE OF A BUILDING FOR HOLDING A RAIN GUTTER IN PLACE

This invention relates to apparatus which may be attached to the outer side wall of a building for holding a rain gutter in place.

SUMMARY OF THE INVENTION

The apparatus from which a rain gutter is suspended, according to the invention, is an elongated element running the length of the gutter. It has two devices for respectively supporting the two legs of a U-shaped rain gutter.

One of these devices is a hook at the lower end of the elonagated element which cooperates with a complementary hook at the upper end of one of the arms of the U-shaped rain gutter, to thus support that arm.

The other of the two devices is a cantilever beam having a bar mounted on one end thereof. The elongated element defines a cavity running the length of the element. There is an entrance opening into the cavity. The bar locks itself in the cavity and the cantilever beam projects outwardly from the cavity, through the entrance opening to the cavity, above the gutter, and connects to the upper end of the other arm of the U-shaped gutter.

The cavity, the entrance opening to the cavity and the bar are so dimensioned that the bar may be inserted into the cavity by aligning the longitudinal axis of the bar with the elongated entrance opening to the cavity. The bar may then enter the cavity. The bar may then be rotated 90 degrees to lock it in the cavity.

The elongated element may be attached to the side of a building by nails or other suitable means. The rear face of the elongated element may be recessed to receive a gasket to prevent flow of water between the side of the building and the elongated element.

BRIEF DESCRIPTION OF THE DRAWINGS

In the drawings:

FIG. 1 is an end view of the rain gutter and the apparatus from which it is suspended.

FIG. 2 is an end view of the elongated element.

FIG. 3 shows the cantilever beam for supporting part of the gutter, together with the bar 13 for locking the beam into the elongated element.

FIG. 4 is a front view of the gutter 10 and the apparatus from which it is suspended, but with the cantilever beam and its associated bar omitted.

DETAILED DESCRIPTION OF THE INVENTION

Rain gutters are generally of U-shape. The rain gutter 10 has a hook 18 at the upper end of one arm 27 of the U, and a flange or horizontal holding piece 17 at the upper end of the other arm 26 of the U.

The gutter 10 is suspended from the elongated element 11, 12, 14, 19. This element may be formed of any suitable material such as metal, plastic or fiberglass. Generally, the elongated element 11, 12, 14, and 19 would be as long as the gutter, however it could be a series of short strips, each a few inches long and secured to the building 30 by two nails.

When the elongated element, 11, 12, 14, and 19 is as long as the gutter it is supported by a series of nails, 20, 21 inserted through nail holes 22 (FIG. 4). The nails enter wood sidewall 30 of a building which may have a roof 31 which drains into the gutter 10.

The elongated element 11, 12, 14, and 19 has a hook 19 running the length of the gutter for mating with the complementary hook 18 on the gutter 10. The left-hand (inner) arm 27 of U-shaped gutter 10, is suspended from the hook 19.

The right-hand (outer) arm 26 of the gutter 10 is supported by the cantilever system 23 which has bar 13 attached to the inner end of the cantilever beam 15. When the beam 15 and bar 13 are properly inserted in the elongated element (as hereinafter described) the beam 15 extends above the gutter 10 and enters the U-shaped upper end of the right-hand (outer) arm 26 of the gutter 10, where it may, if desired, be secured in any suitable manner, for example by a screw 28.

The elongated element 11, 12, 14, and 19 defines a cavity 24 of rectangular cross-section and has an entrance opening 25. The vertical width of opening 25 is greater than the width of bar 13 so that if (as viewed from the right in FIG. 3) it is rotated until its longitudinal axis is horizontal, the bar 13 may then enter the cavity 24 through entrance opening 25. After bar 13 enters the cavity 24 the bar 13 is then rotated by 90 degrees to place cantilever element 23 including beam 15 in the position shown in FIG. 1. Alternatively the bar 13 can be slipped into one end of the elongated element 11, 12, 14, 19 and slid inside the elongated cavity 24 to its desired position.

Irrespective of how bar 13 enters the cavity 24, it is locked therein once the cantilever system 23 is connected to the gutter as shown in FIG. 1. The elongated element 11, 12, 14, 19, therefore, acts as a socket for holding the cantilever system 23.

The elongated element 11, 12, 14, 19 has an upper projection 14, and defines an indent 16. Suitable gasket material may be inserted in the indent 16 to stop leaking of water between the side 30 of the building and the elongated element 11, 12, 14, and 19.

If desired, trim material may be inserted in the slot defined by elements 11 to improve the appearance of the device.

When the elongated element 11, 12, 14 and 19 is in the form of a series of strips each only a few inches long, as mentioned above, the cross-section of each such strip is the same as that of the elongated strip 11, 12, 14, and 19 of FIGS. 1 and 4. The short strips would be close enough together to hold the gutter in place. The use of a series of short strips, instead of a single long one, may save money, but the single long element is desirable when it is desirable to prevent water leakage along the full length of the building.

The bar 13, the cavity 24 and the entrance opening 25 are preferably dimensioned as shown. That is, the vertical width of the entrance opening 25 should be greater than the width of bar 13; that is greater than that dimension of the bar which is perpendicular to the sheet of paper on which FIG. 3 appears. But, the vertical width of opening 25 is preferably less than the vertical height of bar 13 as shown in FIG. 1. The distance from the bottom of cavity 24 to the upper end of entrance opening 25 is preferably less than the vertical length of bar 13 so that the bar is retained in the cavity once properly inserted therein.

The bar 13, the opening 25 and the cavity 24 may alternatively be dimensioned so that the bar 13 may be titled about 30° counterclockwise from the position shown in FIG. 3 and then slid upwardly through opening 25 into the upper portion of cavity 24. The bar 13 may then be rotated until it is vertical and then allowed to drop into bottom part of the cavity 24.

In applications where a great water or ice load may be encountered, the inner arm 27 of the gutter may extend upwardly between the gasket 16 and wall 30 so that it is secured in place by the passage of nails 20 through it. In such a case the cantilever system 23 would remain the same as shown in FIGS. 1 and 3.

The gutter system described in this specification is especially desirable for use on mobile home units, both flat wall and overhang types. By using a continuous fastening strip with gasket material, the gutter will resist leaking and will not put excess stress on the side wall or roof area. This gutter system is easily installed, even by the homeowner.

The invention is also applicable to any form of a building or structure.

I claim to have invented:

1. A gutter and apparatus for positioning the same, comprising:

positioning means for attachment to the side of a building for holding the gutter in place, said positioning means including first gutter holding means, said gutter comprising an upwardly extending gutter wall to be positioned alongside said side of said building, said first gutter holding means holding said gutter wall in place, said gutter having a second upwardly extending wall spaced farther away from the building than said first-named wall, said second upwardly extending wall having an upper end, said positioning means having first and second walls, said first wall being adjacant said side of the building and said second wall spaced farther from the building than the first wall, said second wall defining an opening extending through said second wall, a cantilever arm extending from said cavity, through said opening, and above said gutter, and supporting the upper end of said second upwardly extending wall of said gutter, the portion of said cantilever arm that is in said cavity having an end in said cavity that is enlarged vertically to comprise an enlargement that is higher in the vertical direction than the vertical height of said opening but shorter in the vertical direction than said cavity, said enlargement having upper and lower ends so that the downward force of the gutter on said cantilever arm will force said upper end of said enlargement against a portion of said second wall of said positioning means and will force said lower end of said enlargement against said first wall of said positioning means, whereby to hold said enlargement in place in said cavity, said portion of said second wall being above said opening.

2. In a gutter and apparatus for positioning the same as defined in claim 1 in which said positioning means has a lowest part thereof, said first gutter holding means being adjacent said lowest part and is connected to the upper end of said first-named upwardly extending wall whereby to at least partially support said first-named upwardly extending vertical wall.

3. In a gutter and apparatus for positioning the same as defined in claim 1:

said first gutter holding means being substantially the lowest part of said positioning means, said first-named upwardly extending vertical wall having an upper end, said last-named upper end comprising a hook for engaging said first gutter holding means to support the first-named upwardly extending wall of said gutter.

4. In a gutter and apparatus for positioning the same as defined in claim 3:

said first gutter holding means comprising a second hook that cooperates with said first-named hook to support said first-named upwardly extending wall.

5. Apparatus for supporting the outer generally vertical arm of a generally U-shaped gutter, adjacent a building, comprising:

an element including means for mounting the same along the side of the building to support a gutter, said element having one side to be mounted facing the building and a second opposite side facing away from the building, said element defining a cavity and said second opposite side defining an entrance opening communicating with said cavity, said element with its cavity comprising a socket, a cantilever arm having first and second ends, and means at the first end of said cantilever arm which mates with said socket to support said cantilever arm, whereby the outer generally vertical arm of a U-shaped gutter may be suspended from said arm, said element having a lowermost portion, said U-shaped gutter having an inner generally vertical arm with an upper end, said upper end being directly connected to said lowermost portion to support the inner vertical arm of the U-shaped gutter, in which said opening is elongated horizontally and said cantilever arm having an elongated bar portion in said cavity, said bar portion being transverse to the remainder of said cantilever arm, said opening being longer than the length of said bar and being shorter in a vertical direction than the length of said bar whereby said bar may be inserted into said cavity by turning the bar until its axis is parallel to the longitudinal axis of the opening and once inserted into said cavity may be rotated in said cavity by 90 degrees to its operating position.

6. Apparatus as defined in claim 5 in which said opening is elongated horizontally to a length generally corresponding to that of the gutter.

* * * * *